US005771951A

United States Patent [19]

Bihn

[11] Patent Number: 5,771,951

[45] Date of Patent: Jun. 30, 1998

[54] HANDBAG DISPLAY AND DISPLAY DEVICE

[76] Inventor: Richard Bihn, 1 Sunreigh Ct., Miller Place, N.Y. 11764-3128

[21] Appl. No.: 540,291

[22] Filed: Oct. 6, 1995

[51] Int. Cl.[6] ..... B65D 33/14

[52] U.S. Cl. ..... 150/108; 24/200; 248/316.5; 248/316.7; 248/914

[58] Field of Search ..... 150/108; 24/198, 24/199, 200, 542, 312; 248/316.5, 316.7, 205.3, 914

[56] References Cited

U.S. PATENT DOCUMENTS

| | | | |
|---|---|---|---|
| 2,983,007 | 5/1961 | Gross | 24/200 |
| 3,561,077 | 2/1971 | Grant | 248/316.7 X |
| 4,071,218 | 1/1978 | Pecka et al. | 248/316.7 X |
| 4,400,855 | 8/1983 | Stuart | 24/200 |
| 4,830,322 | 5/1989 | Gary | 248/316.5 X |
| 4,878,641 | 11/1989 | Vogt | 248/316.5 X |
| 4,978,093 | 12/1990 | Kennedy | 248/914 X |
| 5,074,508 | 12/1991 | Powers | 248/205.3 X |
| 5,573,217 | 11/1996 | Garvey et al. | 248/316.7 |

*Primary Examiner*—Stephen P. Garbe
*Attorney, Agent, or Firm*—Galgano & Burke

[57] ABSTRACT

Handbag displays which advantageously increase the efficiency of existing displays by reducing the portion of a display taken up by a handbag strap with a novel handbag display device. A handbag display comprises a handbag having a strap, a support member over which a strap may be hung, and a display device which can be placed on the handbag strap for reducing the distance between the support member and the compartment portion of the handbag and the strap support. When the display device is positioned on a strap, the display device has the effect of reducing the length of the strap and therefore reducing the display area consumed by a handbag.

15 Claims, 3 Drawing Sheets

HANDBAG DISPLAY AND DISPLAY DEVICE

The present invention is directed to novel handbag display devices and a handbag display using such devices.

BACKGROUND OF THE INVENTION

Handbags are used widely throughout the world. When handbags are displayed in a retail environment for sale to consumers, the handbags are often hung from their straps. The length of the strap can cause a significant portion of the display area to be occupied by the straps. Since retail display area is very valuable, this manner of display can result in considerable inefficiencies.

Therefore, it would be highly desirable to provide an improved handbag display which more efficiently utilizes valuable display area.

It would also be highly desirable to provide a handbag display which is more attractive than previously utilized displays.

SUMMARY OF THE INVENTION

Various embodiments of the present invention are directed to handbag displays which advantageously increase the efficiency of existing displays be reducing the portion of a display taken up by a handbag strap. The various embodiments of the present invention utilize novel display devices which are well suited for use with existing displays.

According to one preferred embodiment, a handbag display comprises a handbag having a strap, a support member over which a strap may be hung, and a display device which can be placed on the handbag strap for reducing the distance between the support member and the compartment portion of the handbag. When the display device is positioned on a strap, the display device has the effect of reducing the length of the strap and therefore reducing the display area consumed by a handbag.

The various embodiments of the present invention are designed for quick attachment and removal from a handbag strap. Furthermore, the illustrated embodiments are readily adjustable so that the distance separating the compartment portion of a handbag and a support is readily adjustable.

It will therefore be appreciated that the various embodiments of the present invention provide a novel display which is more efficient than previously known displays and does rot create a risk of harm to the handbag straps nor require the use of paper closures, rubber bands, or knotting of the handbag strap in a unsightly manner.

DETAILED DESCRIPTION

Figure 1:
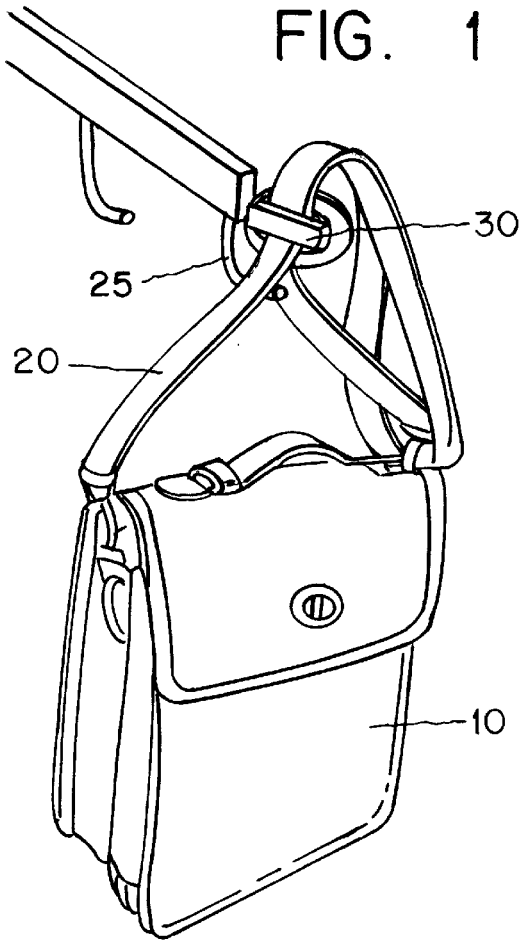
FIG. 1 is a perspective view of a handbag display of the present invention.
Figure 2:
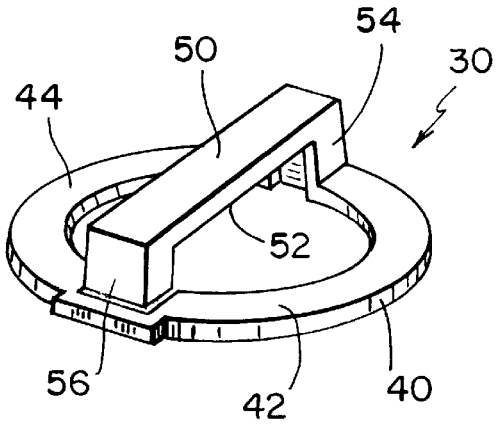
FIG. 2 is a perspective view of a handbag display device of one embodiment of the present invention.
Figure 3:
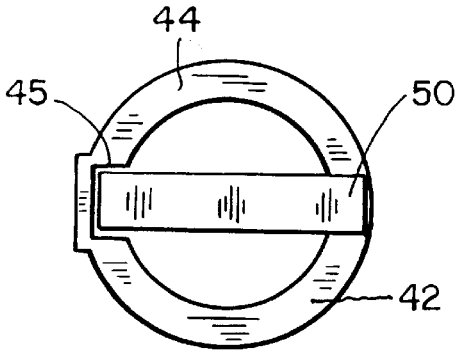
FIG. 3 is a top view of the handbag display device shown in FIG. 2.
Figure 4:
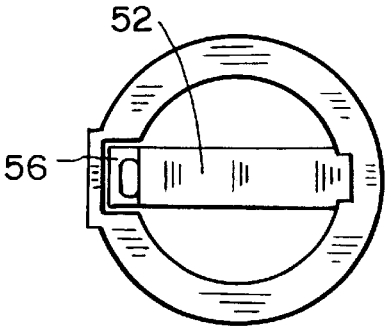
FIG. 4 is a bottom view of the handbag display device shown in FIG. 2.
Figure 5:
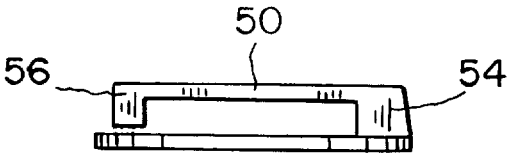
FIGS. 5 and 6 are right and left side views, respectively, of the handbag display device shown in FIG. 2.
Figure 6:
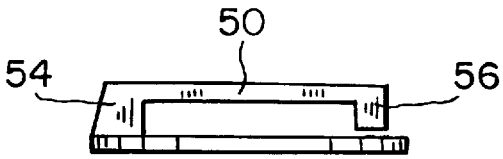
Figure 7:
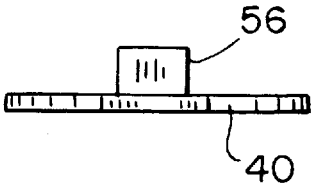
FIGS. 7 and 8 are front and rear views, respectively, of the handbag display device shown in FIG. 2.
Figure 8:
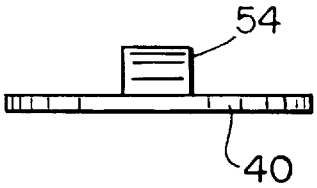

One aspect of the present invention, illustrated in FIG. 1, comprises a novel handbag display. While the embodiment of the present invention illustrated in FIG. 1 shows a conventional pocketbook-type handbag, as used herein the term "handbag" is meant to include any form of carrying device comprising a resilient strap connected to a compartment portion. For example, as used herein, the term "handbag" would include traditional pocketbooks, fanny packs, "wallets on a string", purses, and clutches. In the manner illustrated, a handbag comprising a compartment portion 10 and a strap 20 is suspended from a strap support 25. The strap support 25 may be connected to a display stand, a wall, or the like in a manner known in the art. Furthermore, a display device 30 is provided in order to shorten the effective length of the strap 20.

One embodiment of a handbag display device 30 of the present invention is illustrated in FIGS. 2–8. This embodiment comprises a base 40 forming a first contact surface 42 and a second contact surface 44. According to this illustrated embodiment, base 40 is formed in a generally circular fashion with an inner notch 45. A resilient member 50 comprising a contact surface 52 and a connection portion 54 for connection to base 40 is positioned generally between the first contact surface 42 and the second contact surface 44. While the preferred illustrated embodiments of the handbag display devices 30 of the present invention are integrally formed, it is also possible to separately manufacture one or more portions and then assemble those subcomponents into a handbag display device. Those skilled in the art will appreciate that an integrally formed handbag display device 30 is more economical to manufacture than a device formed of separate elements.

Resilient member 50 advantageously extends across the middle of the illustrated circular base 40. Resilient member 50 is connected to base 40 by connection portion 54 but is not connected at the opposite side of the base 40 proximate notch 45 in order to allow a contact portion 52 of resilient member 50 to be moved further from the contact surfaces of the base for placement and removal of the handbag display device from a strap 20. Resilient member 50 is connected to base 40 in such a manner that member 50 may move a sufficient distance from base 40 to allow a handbag strap to be slid under extension 56 for quick placement on a handbag strap. When the handbag device 30 is properly positioned on a handbag strap, first contact surface 42 of base 40, contact portion 52 disposed on the lower portion of resilient member 50, and second contact portion 44 of base 40 cooperate to releasably maintain the handbag display device 30 on a handbag strap 20 and prevent the strap 20 from slipping through the display device 30. Furthermore, a downward extension 56 may be provided to prevent the unintentional disconnection between handbag display device 30 and a handbag strap. Handbag display device 30 can readily be removed from a handbag strap by simply applying pressure on resilient member 50 in a direction away from the common plane of the contact surfaces thereby allowing a strap to be removed under extension 56.

Figure 9:
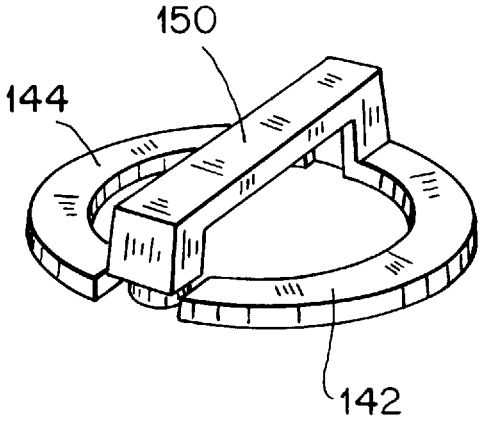
FIG. 9 is a perspective view of a handbag display device of an alternative embodiment of the present invention.
Figure 10:
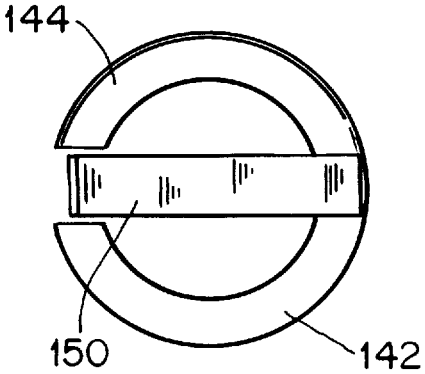
FIG. 10 is a top view of the handbag display device shown in FIG. 9.
Figure 11:
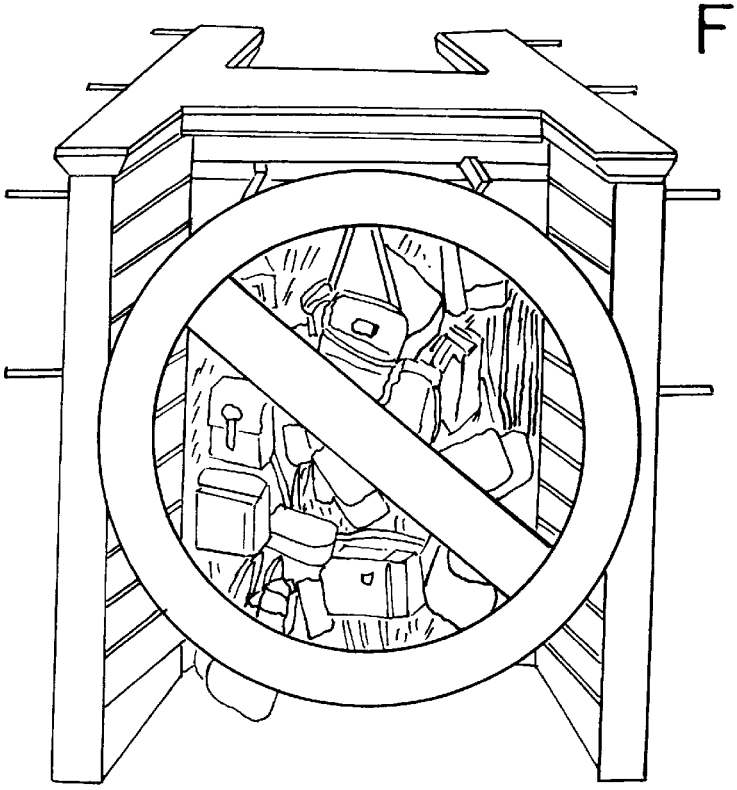
FIG. 11 illustrates a handbag display of the prior art.
Figure 12:
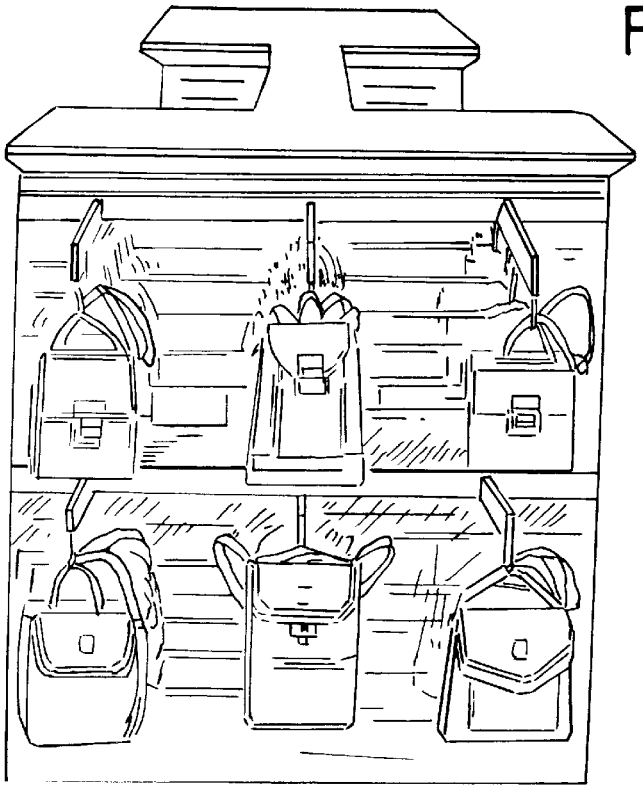
FIG. 12 is a display of the present invention.

An alternative embodiment of the handbag display device of the present invention is illustrated in FIGS. 9 and 10. According to this illustrated embodiment, a first contact portion 142 and a second contact 144 are separately connected to a central movable finger 150. This illustrated embodiment operates in the same manner as the embodiment illustrated in FIGS. 1–8, however, the first contact portion 142 and second contact portion 144 are not connected at the side opposite the connection of movable finger 150.

The various embodiments of handbag display devices of the present invention can be formed of a wide variety of materials such as moldable polymers, e.g., clear styrene, wood, metals or the like. In order to accommodate different sizes and styles of handbag straps, the handbag display devices may also be formed of a variety of different sizes. While the preferred illustrated embodiments are formed having substantially arcuate first and second contact portions, it is also within the scope of the present invention to provide contact portions with different shapes, such as one or more linear segments. For example, the bases can be oval, rectangular or triangular.

What is claimed is:

1. A handbag display comprising:

a handbag comprising a strap and a compartment portion;

a display device for shortening the effective length of said strap comprising:

a base comprising at least a first contact surface and a second contact surface, said first contact surface and said second contact surface disposed in a common plane;

a movable member comprising a contact portion, said movable member connected to said contact surfaces, wherein said contact portion of said movable member is movably positioned between said first contact surface and said second contact surface and in spaced relation to each of said first contact surface and said second contact surface thereby defining a first space between said first contact surface and said contact portion and a second space between said second contact surface and said contact portion;

said movable member comprising a first extension portion which extends at an angle to said common plane and said movable member further comprising a second extension portion which extends from said contact portion toward said common plane;

said contact portion comprises a first end connected to said first extension portion and said contact portion extends substantially from one side of said base to an opposite side of said base;

wherein said strap of said handbag is releasably positioned through said first space and said second space with lower portions of said strap extending from said display device toward said compartment portion of said handbag;

at least one strap support upon which said handbag is suspended.

2. A handbag display device according to claim 1 wherein said base is substantially circular.

3. A handbag display device according to claim 1 wherein a major portion of said contact portion is disposed in a plane substantially parallel to said common plane.

4. A handbag display device according to claim 1 wherein said base further comprises a notch.

5. A handbag display device according to claim 1 wherein said base further comprises an opening proximate said second extension.

6. A handbag display device according to claim 1 wherein said movable member is integrally formed with said base.

7. A handbag display device according to claim 2 wherein said movable member is integrally formed with said base.

8. A handbag display device according to claim 1 comprising a polymeric material.

9. A display device for a handbag with a flexible strap comprising:

a base comprising at least a first contact surface and a second contact surface;

a movable member comprising a first end, a contact portion, and a section end, said first end of said movable member connected to said base, said second end of said movable member not selectively engageable for locking attachment with said base, wherein said contact portion of said movable member is movably positioned in spaced relation to each of said first contact surface and said second contact surface thereby defining a first space between said first contact surface and said contact portion and a second space between said second contact surface and said contact portion whereby a strap of a handbag may be releasably positioned through said first space and said second space with lower portions of said strap extending from said display device toward a compartment portion of said handbag.

10. A display device according to claim 9 wherein said movable member comprises a first extension portion which extends to an angle to said common plane; and said contact portion comprises a first end connected to said extension portion and said contact portion extends substantially from one side of said base to an opposite side of said base.

11. A display device according to claim 10 wherein a major portion of said contact portion is disposed in a plane substantially parallel to said common plane.

12. A display device according to claim 10 wherein said resilient member further comprises a second extension which extends from said contact portion toward said common plane.

13. A display device according to claim 12 wherein said base further comprises an opening proximate said second extension.

14. A display device according to claim 9 wherein said movable member is integrally formed with said base.

15. A display device according to claim 9 wherein said base is substantially circular.

* * * * *